US011821649B2

(12) United States Patent
Roj

(10) Patent No.: US 11,821,649 B2
(45) Date of Patent: Nov. 21, 2023

(54) MODULAR ELEMENTS FOR PORTIONS OF BUILDING FAÇADES AND PROCESSES FOR REMOVING AND REPLACING SUCH PORTIONS

(71) Applicants: Progetto CMR S.r.l., Milan (IT); Focchi S.p.A., Poggio Torriana (IT)

(72) Inventor: Massimo Roj, Milan (IT)

(73) Assignees: PROGETTO CMR S.r.L., Milan (IT); FOCCHI S.p.A., Poggio Torriana (IT)

( * ) Notice: Subject to any disclaimer, the term of this patent is extended or adjusted under 35 U.S.C. 154(b) by 103 days.

(21) Appl. No.: 17/066,715

(22) Filed: Oct. 9, 2020

(65) Prior Publication Data

US 2021/0108825 A1 Apr. 15, 2021

(30) Foreign Application Priority Data

Oct. 11, 2019 (IT) ..... 102019000018620

(51) Int. Cl.
*F24F 13/20* (2006.01)
*F24F 11/88* (2018.01)
(Continued)

(52) U.S. Cl.
CPC ..... *F24F 13/20* (2013.01); *F24F 5/0046* (2013.01); *F24F 11/0001* (2013.01);
(Continued)

(58) Field of Classification Search
CPC ..... F24F 13/20; F24F 13/222; F24F 13/224; F24F 5/0046; F24F 11/0001; F24F 11/88; F24F 2005/0064; F24F 2221/36; F24F 2221/20; F24F 1/0007; E04G 21/167; E04G 21/243; E04G 23/0296; E04B 2/90
See application file for complete search history.

(56) References Cited

FOREIGN PATENT DOCUMENTS

CN 102080938 A * 6/2011
CN 205475754 U * 8/2016
(Continued)

OTHER PUBLICATIONS

Italian Search Report and Written Opinion in corresponding Italian Application No. 102019000018620 dated Jul. 1, 2020, 8 pages.

*Primary Examiner* — Emmanuel E Duke
(74) *Attorney, Agent, or Firm* — MH2 TECHNOLOGY LAW GROUP LLP

(57) ABSTRACT

A modular element for a façade of a building may include: an air conditioning unit; and a channeling system. The channeling system may be configured to receive fluid from an external source. The channeling system may include at least one first channel entering the air conditioning unit. The external fluid source may include a pump configured to circulate the fluid inside the channeling system. The channeling system further may include one or more inlets configured to connect to the pump so as to receive the fluid from the external source and input the fluid into the at least one first channel of the channeling system. The channeling system further may include at least one second channel configured to connect to an internal diffusion element of the building. The at least one second channel may be configured to transport the fluid from the external source to the internal diffusion element.

8 Claims, 6 Drawing Sheets

(51) Int. Cl.
*F24F 5/00* (2006.01)
*F24F 11/00* (2018.01)
*F24F 13/22* (2006.01)

(52) U.S. Cl.
CPC ..... *F24F 11/88* (2018.01); *F24F 13/222* (2013.01); *F24F 2005/0064* (2013.01); *F24F 2221/36* (2013.01)

(56) References Cited

FOREIGN PATENT DOCUMENTS

| | | | | | |
|---|---|---|---|---|---|
| CN | 104988996 | B | * | 7/2017 | |
| DE | 10307047 | A1 | * | 9/2004 | ..... F24F 12/006 |
| DE | 202009004141 | U1 | | 7/2009 | |
| DE | 102008007641 | A1 | | 8/2009 | |
| DE | 102008039010 | A1 | | 2/2010 | |
| EP | 1467157 | A1 | * | 10/2004 | ..... F24S 20/66 |
| EP | 1674648 | A1 | * | 6/2006 | ..... E04B 2/88 |
| EP | 2886968 | A1 | | 6/2015 | |
| IT | 1218141 | B | * | 4/1990 | |

* cited by examiner

MODULAR ELEMENTS FOR PORTIONS OF BUILDING FAÇADES AND PROCESSES FOR REMOVING AND REPLACING SUCH PORTIONS

CROSS-REFERENCE TO RELATED APPLICATION(S)

This application claims priority under 35 U.S.C. § 119 from Italian Patent Application No. 102019000018620, filed on Oct. 11, 2019, in the Italian Patent and Trademark Office ("IPTO"), the entire contents of which are incorporated herein by reference.

The present invention relates to a modular element comprising an integrated air conditioning unit and adapted to replace a façade portion of a building in correspondence with at least one floor of the building and a corresponding process for removing and replacing the façade portion with the modular element.

TECHNICAL FIELD

In the construction sector, it is known that the restructuring and renovation of a building in order to improve the performance, functionality, image and comfort thereof may require several separate interventions. In fact, an intervention is often necessary to replace the façade of a building and a further separate intervention to renovate the heating and/or cooling system of the building in order to adapt to the new energy classes and to improve the comfort of the interior environment. The need to carry out separate interventions can result in higher costs for the building owner and simultaneously increase the duration of the renovation works and unforeseen events during the construction site works.

It is also known that, while renovating the façade of a building, which involves the replacement of portions of the façade, the entire building is usually cleared of the occupants and furnishings thereof for as long as the construction site works are in operation.

Considering therefore the long duration of the entire renovation works of the building, all this entails a significant inconvenience, as well as a significant loss of income if the building is leased and/or usufruct if owned. These costs are in addition to the actual costs of renovating the façade and the building as a whole.

AIM OF THE INVENTION

The object of the invention is to provide a modular element comprising an integrated air conditioning unit and adapted to replace a façade portion of a building in correspondence with at least one floor of the building which allows the building to be renovated both aesthetically and energetically, meeting formal and functional needs.

An object of the invention is also to present a building renovation process which allows to restore the façade of the building without compromising habitability during both the removal and replacement of the portions constituting the façade.

This and other objects, which will become clearer from the following description, are achieved by the modular element and the process according to the invention, which are characterized in accordance with the claims set forth below.

Advantages of the Invention

The advantage achieved with the invention is that of allowing both the aesthetic and energetic renovation of the building with a single coordinated intervention on the outer casing rather than through non-coordinated construction works.

At the same time, the invention allows the enhancement of the building through a contemporary architecture which is more aesthetically appealing. In addition, the invention allows to eliminate the inconvenience and/or loss of income resulting from the need to have the property free of occupants, as conventionally occurs in the application of building renovation processes in accordance with the prior art.

Still advantageously, the invention allows to reduce construction site intervention costs and contingencies.

BRIEF DESCRIPTION OF THE DRAWINGS

The invention will now be described further with reference to some of the practical embodiments thereof, given by way of non-limiting example only, illustrated in the accompanying drawings in which.

DETAILED DESCRIPTION

Figure 1:
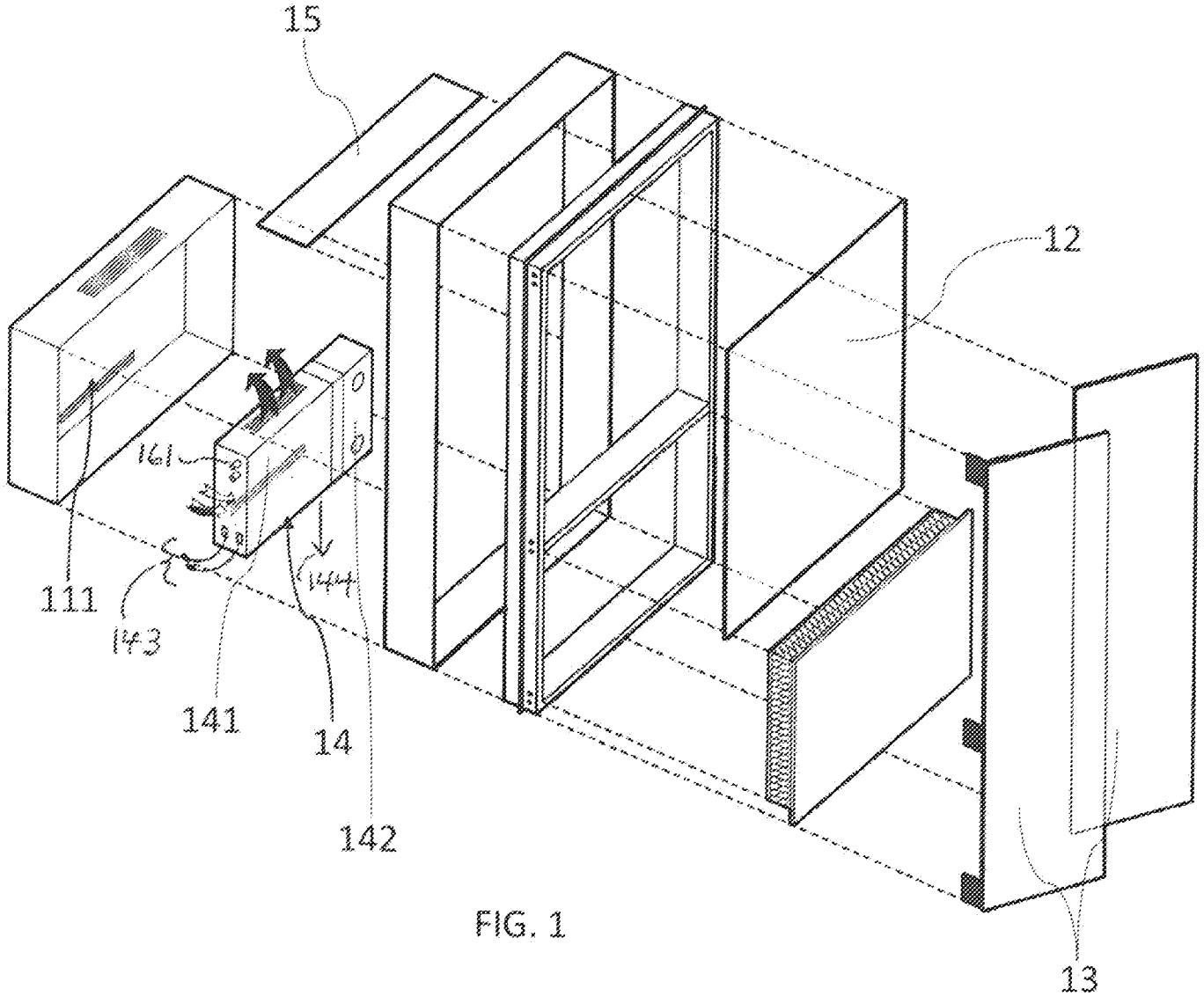
FIG. 1 shows a perspective, exploded view of a modular element in accordance with the invention.
Figure 2:
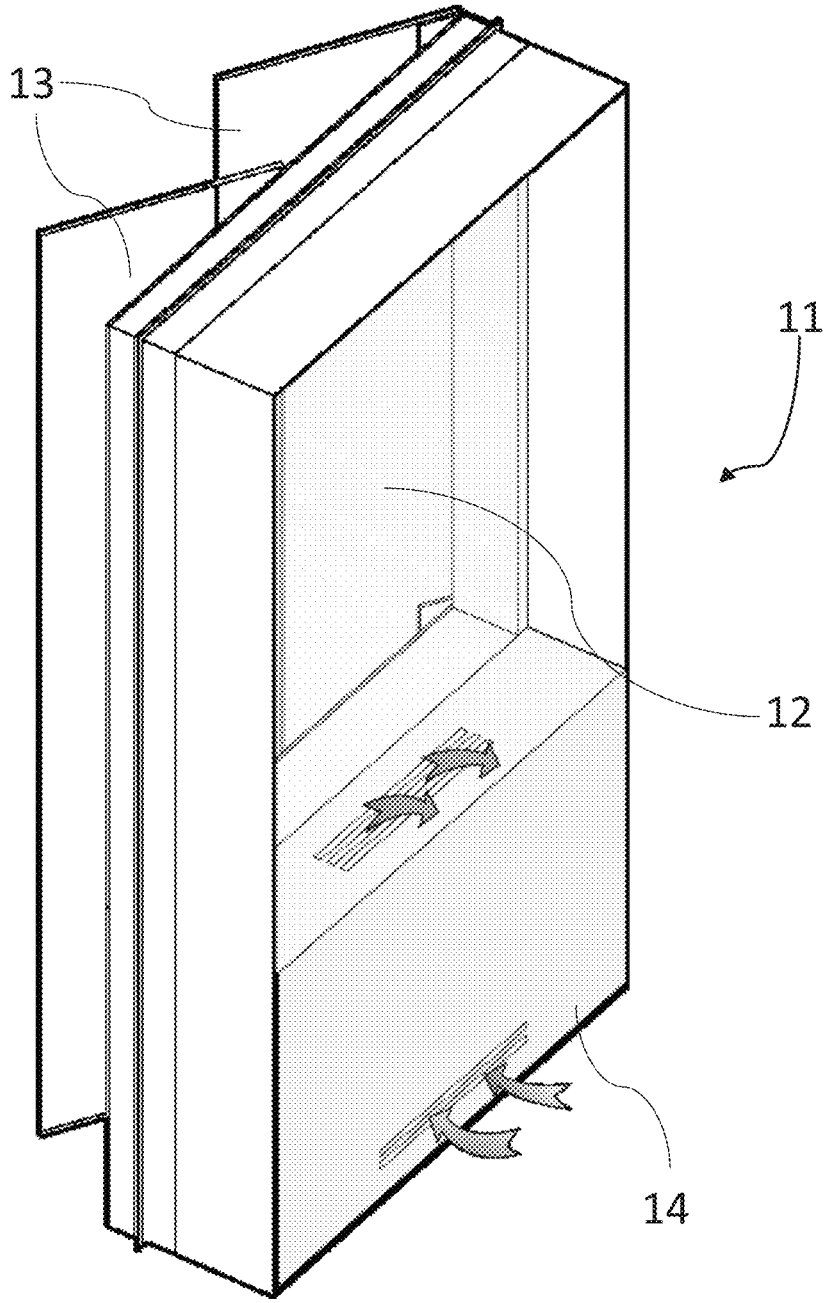
FIG. 2 shows a perspective view of the modular element of FIG. 1.

With reference to the aforementioned figures, FIGS. 1 and 2 show a modular element 11 adapted to replace a portion 8*a* of the façade 8 of a building in correspondence with at least one floor A, B, C, D of the building. Preferably, such modular element 11 has a surface extension corresponding to the portion 8*a* of the façade 8 to be removed. Alternatively, the modular element 11 may have a surface extension different than the surface extension of the portion 8*a* of the façade 8 to be removed in order to meet functional needs.

Such modular element 11 comprises an air conditioning unit 14 and a channeling system 16. The air conditioning unit 14 is housed inside a recess 111 of the modular element 11. It should be noted that the dimensions of the air conditioning unit 14 are such as to allow the integration thereof inside the modular element 11. The channeling system 16 comprises one or more channels, including at least one first channel 161 entering the air conditioning unit 14. Furthermore, the channeling system 16 is configured to receive a fluid from an external fluid source 17. The fluid may be a liquid or a gas.

The external fluid source 17 comprises a pump 171 for circulating the fluid inside the channeling system 16. The external fluid source 17 preferably also comprises means for heating and/or cooling the fluid. However, in some cases these means may be omitted in whole or in part. For example, in an embodiment where the fluid is a gas, such means for heating and/or cooling the fluid are only used to cool the fluid. In fact, in the case where the fluid is a gas, the heating can take place inside the modular element 11. That is, the modular element 11 may comprise a direct expansion system (not shown in the accompanying figures) for heating the gas.

In detail, the channeling system 16 comprises one or more inlets 165 configured to be connected to the external fluid source 17 so as to receive the fluid from the external fluid source 17 and input it into the channels of the channeling system 16. This fluid can therefore circulate in the channeling system 16, and in particular in the at least one first channel 161.

The air conditioning unit 14 comprises a mechanical ventilation element 142 configured to generate an air inflow into the building and an air outflow from the building, and to exchange heat therebetween. That is, the mechanical ventilation element is configured to heat and/or cool the air inflow. Preferably, said mechanical ventilation element 142 consists of a double cross-flow exchanger for optimized and constant thermal recovery.

The air conditioning unit 14 further comprises a hot and/or cold air diffusion element 141 configured to heat and/or cool the air inflow, and thus the interior environment of the building, using the fluid circulating in the at least one first channel 161 and to input the air inflow into the interior environment of the building. For example, the diffusion element 141 is configured to input the air inflow into the interior of the building via an inlet facing the interior of the building when the modular element 11 is installed in the building.

The heating and/or cooling of the air inflow preferably takes place downstream of the mechanical ventilation element 142, by heat exchange between the airflow and the fluid in the at least one first channel 161. The configurations of the diffusion element 141 and the at least one first channel 161 which allow the best heat exchange are known to those skilled in the art and will therefore not be explored here.

In addition, the air conditioning unit 14 comprises an electronic control element 143 configured to control the hot and/or cold air diffusion element 141 and the mechanical ventilation element 142. The electronic control element 143 allows to control the diffusion element 141 and the mechanical ventilation element 142 according to the air conditioning and thermal comfort needs of the interior environment of the building. In other words, the electronic control element 143 allows to control the degree of heating and/or cooling of the air inflow while simultaneously controlling the air exchange in the interior environment of the building and thus the air quality inside the building.

According to a preferred embodiment of the invention, the channeling system 16 comprises at least one second channel 162 connectable to an internal diffusion element 18 of the building which is distinct from the diffusion element 141 inside the modular element 11. In other words, the channeling system 16 comprises one or more outlets connectable to the internal diffusion element 18 of the building. The inlet 165 is then configured to convey the fluid provided by the external fluid source 17 to the internal diffusion element 18 of the building, and is preferably connected between at least one second channel 162 and at least one outlet 164.

The internal diffusion element 18 of the building is configured to generate hot and/or cold air using the fluid circulating in the at least one second channel 162.

Advantageously, by connecting the at least one second channel 162 to the internal diffusion element 18 of the building it is possible to respond to differentiated air conditioning requirements of the internal environment of the building according to the specificity of the building and of the user and to formal and functional needs.

According to the preferred embodiment of the invention, the air conditioning unit 14 comprises a drainage channel 144. Such drainage channel 144 is configured to drain condensate water produced by the diffusion element 141 to the ground.

Preferably, the modular element 11 comprises windows 12 embedded in the frame of the modular element 11. Still preferably, the windows 12 may incorporate curtains for protection from the sun's rays.

According to the preferred embodiment of the invention, the modular element 11 comprises panels 13 for the partial or total darkening of sunlight. That is, such panels 13 allow the window 12 to be partially or totally darkened. Such panels 13 may be arranged parallel or perpendicular to the window 12, or at intermediate angles, depending on the solar exposure of the building.

Preferably, such panels 13 include devices for generating energy from renewable sources. For example, such panels 13 may be photovoltaic panels.

Preferably, such power generation devices may contribute to the operation of the air conditioning unit 14. More preferably, such power generation devices may contribute to the power supply of the air conditioning unit 14.

According to the preferred embodiment of the invention, the modular element 11 comprises at least one shelf 15 treated with solar rays reflective coating. Such shelf 15 faces the interior of the building when the modular element 11 is installed in the façade 8 of the building. In other words, once the modular element 11 is installed in the façade 8 of the building, reflecting the sun's rays, this shelf 15 allows to improve the diffusion of natural light and limit the risk of glare of the interior environment.

Figure 3:
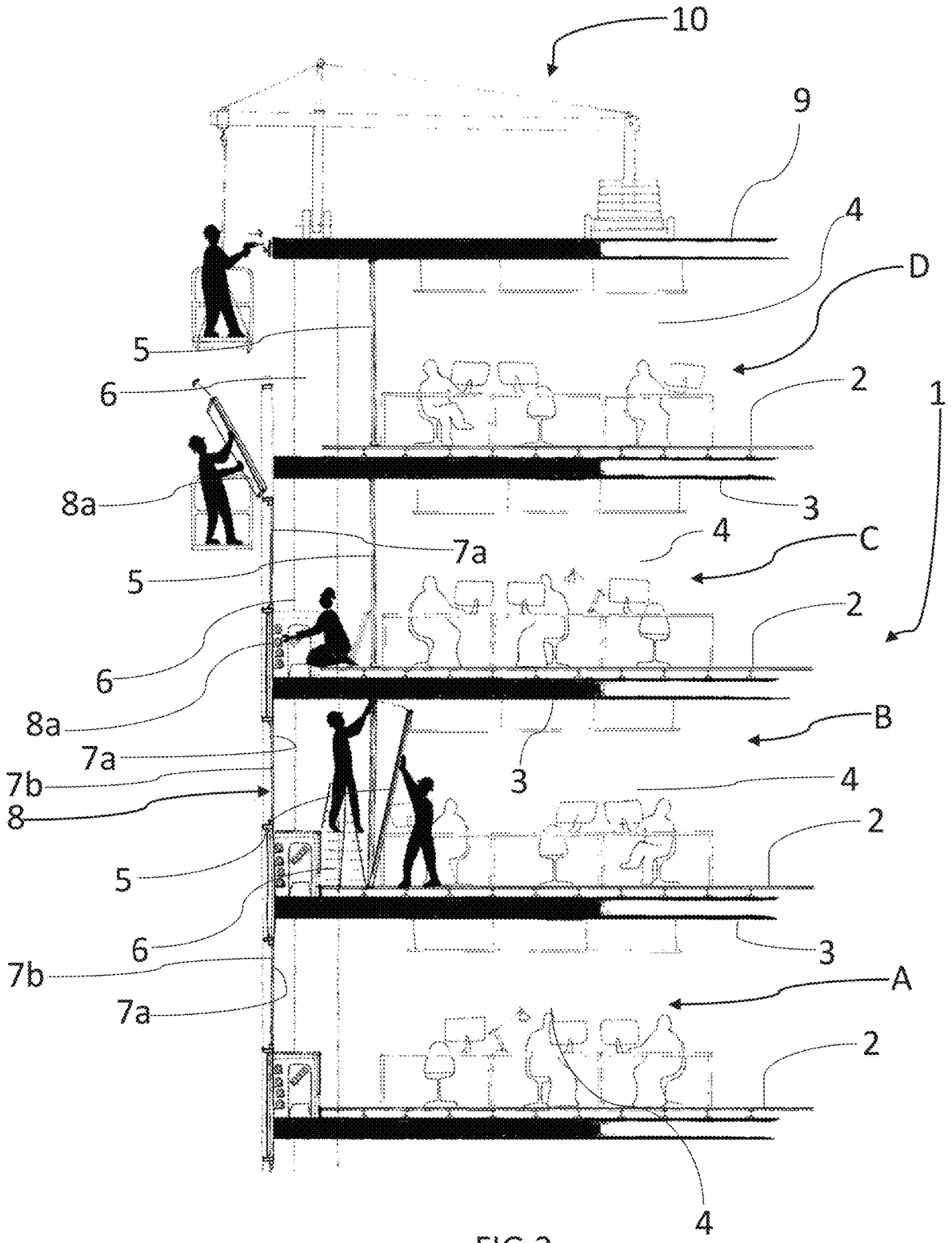
FIG. 3 shows a schematic view, in vertical section, of a multi-story building, in which the first steps of the process are implemented with the arrangement of the separation bulkhead of the construction site area on each floor and the removal of portions of the façade to be replaced.

With reference to the aforementioned figures, FIG. 3 schematically illustrates the preliminary steps of the process.

The section of the building has been indicated comprehensively with the number 1 and the flooring surfaces of the floors A, B, C, D have been indicated with the number 2, while the respective ceilings have been indicated with 3.

The habitable area in which the furnishings and occupants of the building may be present, also during the construction site works, has been indicated overall with the reference number 4.

According to the first step of the process, this involves the erection of a vertically extending bulkhead 5 between a flooring surface 2 of a floor A, B, C, D and a corresponding overlying ceiling 3.

The bulkhead 5 is removable and capable of delimiting a construction site area 6 between the internal surface 7*a* of the portion 8*a* of the façade 8 to be removed and the rear habitable area 4 which continues to be inhabited and in operation, of the floor A, B, C, D of the building where the furnishings and occupants are located.

According to the second step of the process, suspension means comprehensively indicated with the number 10 are provided, for access from the outside to an external surface 7*b* of the portion 8*a* of the façade 8 to be removed. Preferably, such suspension means 10 are arranged on the roof floor 9 of the building 1. Alternatively, such suspension means 10 are arranged on the ground, in front of the building 1.

This avoids the need to arrange an extensive construction site area around the building with obvious economic savings.

The third step of the process is implemented by means of the aforementioned suspension means 10, which involves the removal of the single portion 8*a* of the façade 8 of the façade of the floor A, B, C, D, as schematically illustrated in FIG. 3 with reference to the floor D.

Figure 4:
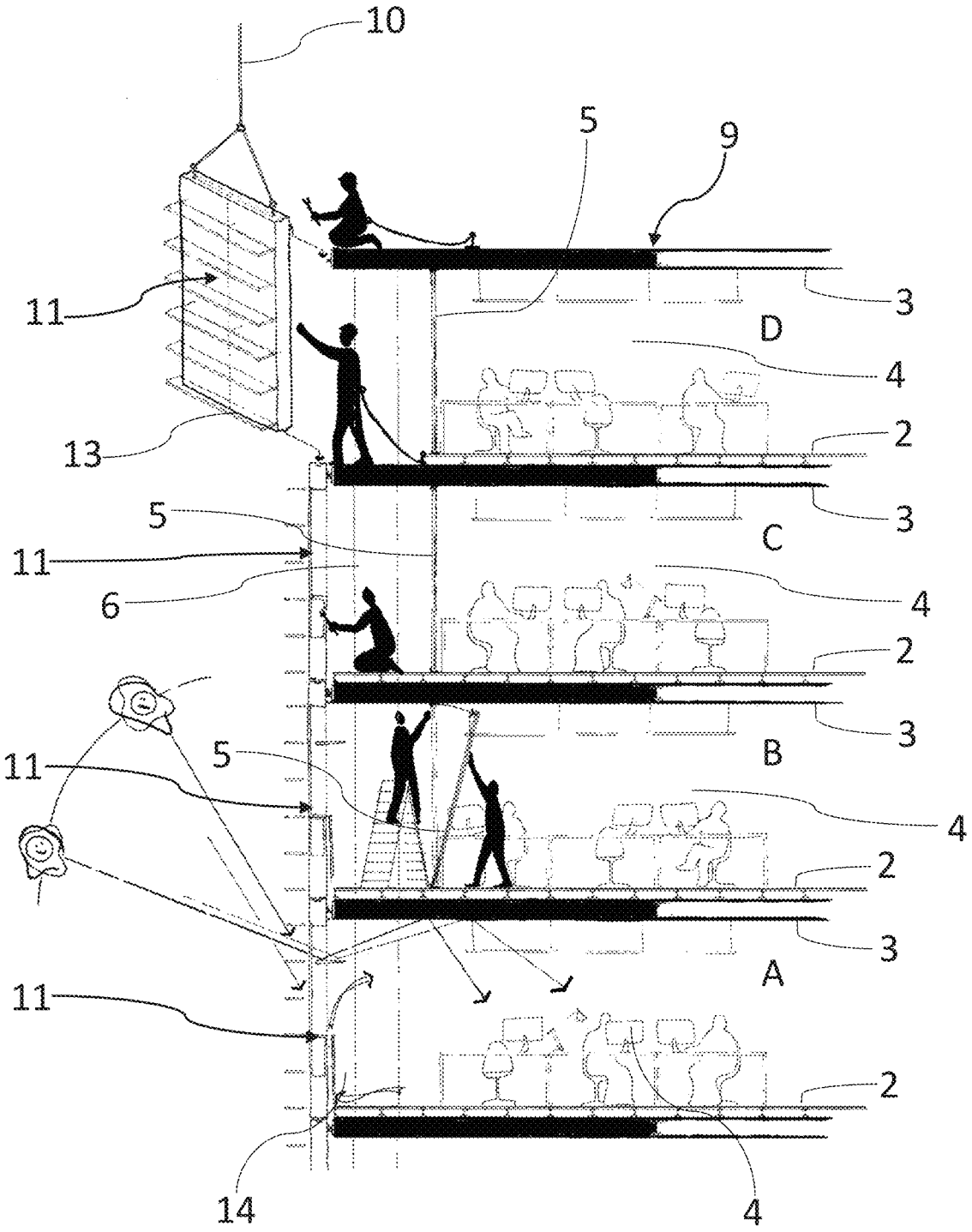
FIG. 4 shows a schematic view, in vertical section, of a multi-story building, where the further steps of the process are implemented in which modular elements are installed.
Figure 5:
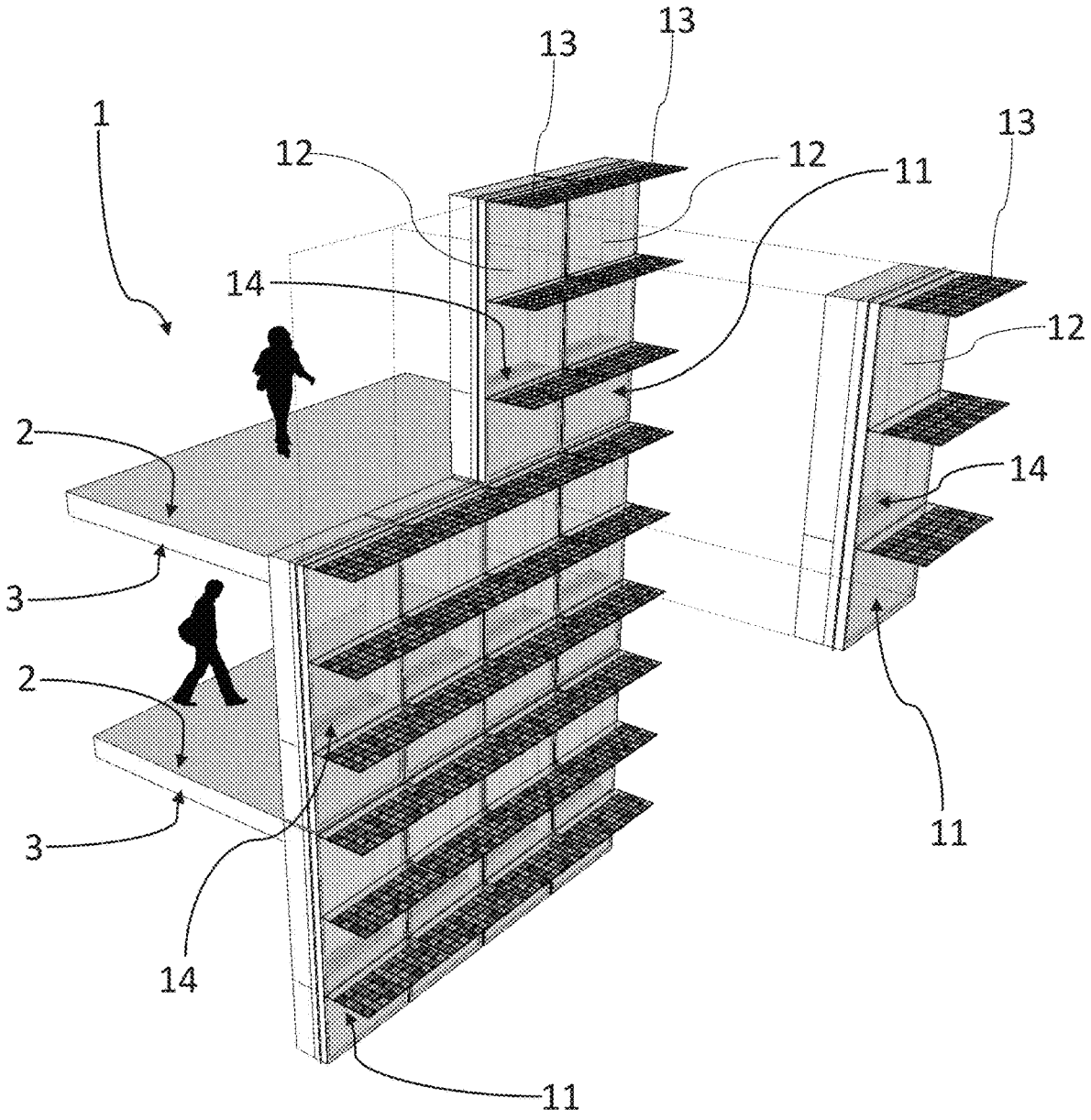
FIG. 5 shows a schematic perspective view of a renovated building façade portion according to the process of the invention in which modular elements in accordance with the invention are installed.
Figure 6:
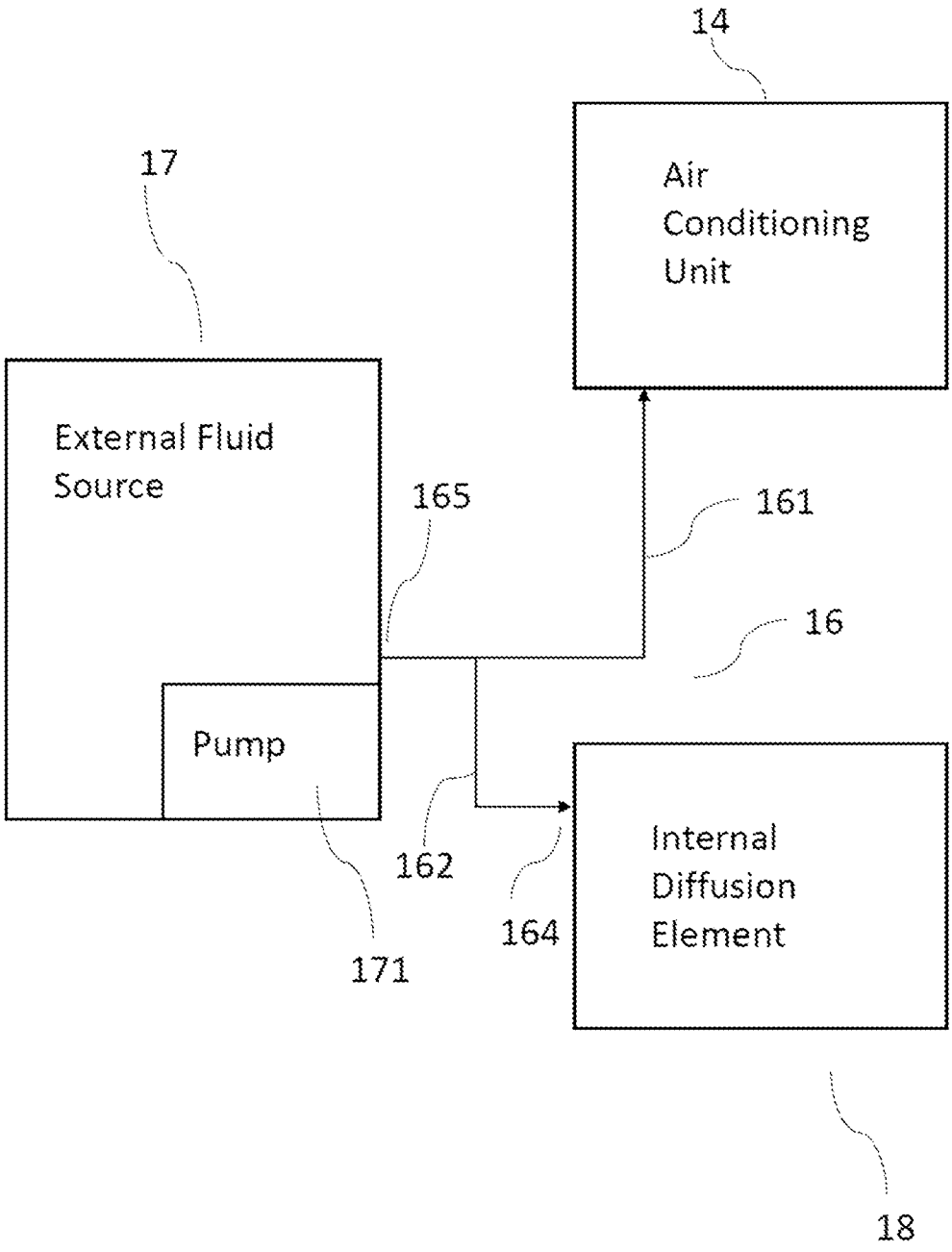
FIG. 6 shows a schematic view of an air conditioning unit, a channeling system, an external fluid source, and an internal diffusion element of the present application.

Referring to FIG. 4, the fourth step of the process according to the invention involves the installation, with the use of the suspension means 10, of the modular element 11. As previously introduced, preferably, the modular element 11 corresponds in size to the removed portion 8*a* of the façade 8. Alternatively, the modular element 11 may be different in size from the removed portion 8*a* of the façade 8 to meet formal and functional renovation needs.

The process thus comprises a further step in which the modular element 11 is anchored to the façade 8 of the building 1 and electrical and hydraulic connections of the air conditioning unit 14 are performed. For example, the frame of the modular element 11 is connected to a corresponding floor A, B, C, D of the building, while the air conditioning unit 14 is connected to the electrical supply network of the building and the channeling system 16 is connected to the external fluid source 17, as well as to any internal diffusion elements 18 of the building.

Subsequently, the bulkhead 5 is removed with consequent elimination of the construction site area 6 and restoration of the full and total usability of the entire floor A, B, C, D as schematically shown at the floor A of FIG. 4.

It should be noted that the process described above can be applied to replace the entire façade 8 of the building with a plurality of modular elements 11. That is, the process can be applied to replace a plurality of portions 8*a* of the façade 8 with a plurality of modular elements 11, thereby allowing the entire building to be renovated.

The materials as well as the dimensions of the disclosed elements may vary according to needs without thereby departing from the scope of the following claims.

The invention claimed is:

1. A modular element for a façade of a building, the modular element comprising:

an air conditioning unit; and a channeling system;

wherein the channeling system is configured to receive fluid from an external fluid source, wherein the channeling system comprises at least one first channel entering the air conditioning unit, wherein the external fluid source comprises a pump configured to circulate the fluid inside the channeling system, wherein the channeling system further comprises one or more inlets configured to connect to the pump so as to receive the fluid from the external fluid source and to input the fluid into the at least one first channel of the channeling system, wherein the air conditioning unit comprises:

a mechanical ventilation element configured to generate air inflow into the building, to generate air outflow from the building, and to exchange heat therebetween;

a hot and/or cold air diffusion element configured to heat and/or cool the air inflow using the fluid circulating in the at least one first channel and to input the air inflow into an interior environment of the building; and an electronic control element configured to control the hot and/or cold air diffusion element and the mechanical ventilation element;

wherein the channeling system further comprises at least one second channel configured to connect to an internal diffusion element of the building, and wherein the at least one second channel is configured to transport the fluid from the external fluid source to the internal diffusion element of the building.

2. The modular element of claim 1, wherein the air conditioning unit further comprises a drainage channel, and wherein the drainage channel is configured to drain condensation water produced by the hot and/or cold air diffusion element to the ground.

3. The modular element of claim 1, further comprising:

panels for partial or total darkening of sunlight.

4. The modular element of claim 3, wherein the panels include devices for generating energy from renewable sources.

5. The modular element of claim 1, further comprising:

at least one shelf treated with solar-rays-reflective coating;

wherein the at least one shelf is configured to face an interior of the building when the modular element is installed in the façade of the building.

6. A process for removing and replacing a portion of a façade of a building with a modular element, without affecting habitability and operability of the building, the process comprising:

erecting, inside the building, in correspondence with a floor thereof, a vertically extending bulkhead between a flooring of the floor and a corresponding overlying ceiling, wherein the bulkhead is removable and is configured to delimit a construction site area between an inner surface of the portion of the façade to be removed and a rear habitable area of the floor of the building;

arranging suspension means for access from outside an external surface of the portion of the façade to be removed;

individually removing the portion of the façade of the floor; and installing the modular element;

wherein the modular element comprises:

an air conditioning unit; and a channeling system;

wherein the channeling system is configured to receive fluid from an external fluid source, wherein the channeling system comprises at least one first channel entering the air conditioning unit, wherein the external fluid source comprises a pump configured to circulate the fluid inside the channeling system, wherein the channeling system further comprises one or more inlets configured to connect to the pump so as to receive the fluid from the external fluid source and to input the fluid into the at least one first channel of the channeling system, wherein the air conditioning unit comprises:

a mechanical ventilation element configured to generate air inflow into the building, to generate air outflow from the building, and to exchange heat therebetween;

a hot and/or cold air diffusion element configured to heat and/or cool the air inflow using the fluid circulating in the at least one first channel and to input the air inflow into an interior environment of the building; and an electronic control element configured to control the hot and/or cold air diffusion element and the mechanical ventilation element;

wherein the channeling system further comprises at least one second channel configured to connect to an internal diffusion element of the building, and wherein the at least one second channel is configured to transport the fluid from the external fluid source to the internal diffusion element of the building.

7. The process of claim 6, further comprising:

anchoring the modular element to the façade; and connecting electrical and hydraulic connections of the air conditioning unit.

8. The process of claim 6, further comprising:

removing the bulkhead delimiting the construction site area of the floor of the building.

* * * * *